US005423574A

United States Patent [19]

Forte-Pathroff

[11] Patent Number: 5,423,574

[45] Date of Patent: Jun. 13, 1995

[54] CHILD LOSS PREVENTION SYSTEM AND METHOD OF USE

[76] Inventor: Denise Forte-Pathroff, 5601 Highway 1804 South, Bismark, N. Dak. 58504

[21] Appl. No.: 165,380

[22] Filed: Dec. 10, 1993

[51] Int. Cl.[6] ..... B42D 15/00

[52] U.S. Cl. ..... 283/75; 283/74

[58] Field of Search ..... 283/75, 74, 72, 70, 283/900; 40/633

[56] References Cited

U.S. PATENT DOCUMENTS

| | | | |
|---|---|---|---|
| 4,226,036 | 10/1980 | Krug | 283/75 X |
| 4,614,366 | 9/1986 | North et al. | 283/75 X |
| 4,730,849 | 3/1988 | Siegel | 283/75 X |
| 4,914,843 | 4/1990 | DeWoskin | 283/75 X |
| 5,006,830 | 4/1991 | Merritt | 283/75 X |

*Primary Examiner*—Willmon Fridie
*Attorney, Agent, or Firm*—Moore & Hansen

[57] ABSTRACT

The child loss prevention system includes a wrist bracelet that is given to a child and accompanying adult at the time the child is left with a child care facility or upon entering a large public facility such as a shopping mall or amusement park. Information printed on the bracelet at that time may be in the form of a bar code or a string of alphanumeric characters, or a combination of the two. When the adult attempts to leave the facility with the child, the material printed on the bracelet of each of them is scanned, and if the information matches, the child is allowed to leave with the adult.

17 Claims, 2 Drawing Sheets

CHILD LOSS PREVENTION SYSTEM AND METHOD OF USE

BACKGROUND OF THE INVENTION

1. Technical Field

The present invention relates generally to devices used to prevent the removal of children from public facilities such as amusement parks, day care centers or shopping malls without the knowledge or consent of the child's parents. More specifically, the invention relates to apparatus for supplying unique identification codes that may be assigned to the child and the responsible adult accompanying the child, which codes must be compared and matched before the child will be permitted to leave the facility with the adult.

2. Background Information

It is perhaps the greatest fear of a parent to lose a child. It is, therefore, only with the greatest anxiety that many parents will leave their child in the custody of a stranger while enjoying adult recreation or other activities that could not be enjoyed when also burdened with the responsibility of caring for a child. Even going to a large public facility such as an amusement park may be stressful due to the knowledge that children have the ability to disappear when a parent looks away even for just a moment.

Yet every day many children are kidnapped or otherwise lured away by strangers unbeknownst to their parents or other adult supervisors. It is frequently only after the child has been missing for some time that the responsible adults realize that the child is absent, and then it may be too late to find the child if the person who took the child does not want the child to be found.

Presently, systems are available that permit the assignment of name tags to children, which may be used by child care personnel to identify the child when the adult responsible for that child comes to claim the child. Alternatively, an identification ticket or voucher may be given to the adult that must be presented before the child will be released. Both of these systems are subject to abuse, however. Obviously, in the former situation, an adult would only need to know the name of the child, and perhaps some distinguishing characteristic, in order to claim that child to the satisfaction of child care personnel. In the latter situation, the voucher may be lost or misappropriated, or a suitable facsimile produced, permitting an adult to claim the child of another based on the presentation of a forged or stolen voucher.

It is important to remember that very young children may lack the maturity to distinguish between familiar and strange adults. It may be very easy to lure an unsuspecting child away from a group of family or friends in a busy place with large crowds, such as a shopping mall or amusement park. Children may even walk off on their own. Yet parents will sometimes try to keep their children with them, even if they are distracted by adult amusements, because they do not feel secure in the knowledge that an available child care facility will provide adequate security for their child.

It is also known to place an electronically and visually detectable article of clothing on a child, especially an infant, that allows easy detection of a child that has been removed from a secure area. However, in the case of a large area such as an amusement park, a kidnapper may easily change the clothing, or even the appearance as by cutting off the hair, of a child before leaving the premises with the child. Such an article, when easily removed or disguised, provides no security unless personnel visually notice that the article is missing. Even then, an adult may persuade the personnel that the parent has taken ill or give some other plausible, albeit false, excuse for why they are attempting to leave with the child.

The child loss prevention system of the present invention overcomes difficulties described above and affords other features and advantages heretofore not available.

SUMMARY OF THE INVENTION

The present invention provides for identification bracelets, similar to those given to hospital patients, that are placed on the wrists of the child being place with the child care facility, as well as the adult who is responsible for retrieving the child. The bracelets include information, either in the form of a bar code, an alphanumeric sequence, or a combination of the two, that is unique to that child and adult.

For the child to be removed from the child care facility by the adult, the bracelets of both child and adult must be scanned by an electronic scanner, and the data on those bracelets must be compatible, or the adult will not be allowed to take the child. Complementary information may be provided for a group of any size, so that one or more adults may be responsible for retrieving one or more children. However, each adult and each child must be present at the time of preparing the data printed on the bracelets, and must immediately put on the bracelet in the presence of child care personnel.

Once the bracelet has been put on, it may not be removed without causing obvious damage to the bracelet. An adult with a bracelet showing evidence of tampering would not be allowed to remove a child from the child care facility.

To retrieve a child from the child care facility, the bracelets of the child and the adult are scanned by a handheld scanner to ensure that the data on the bracelets show that the adult and the child indeed belong together. If there is a discrepancy in the data as read by the scanning equipment, the child will not be allowed to leave the premises with that adult. Only after passing the final checkpoint established by the facility using the present invention should the adults and children remove their wrist bracelets.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
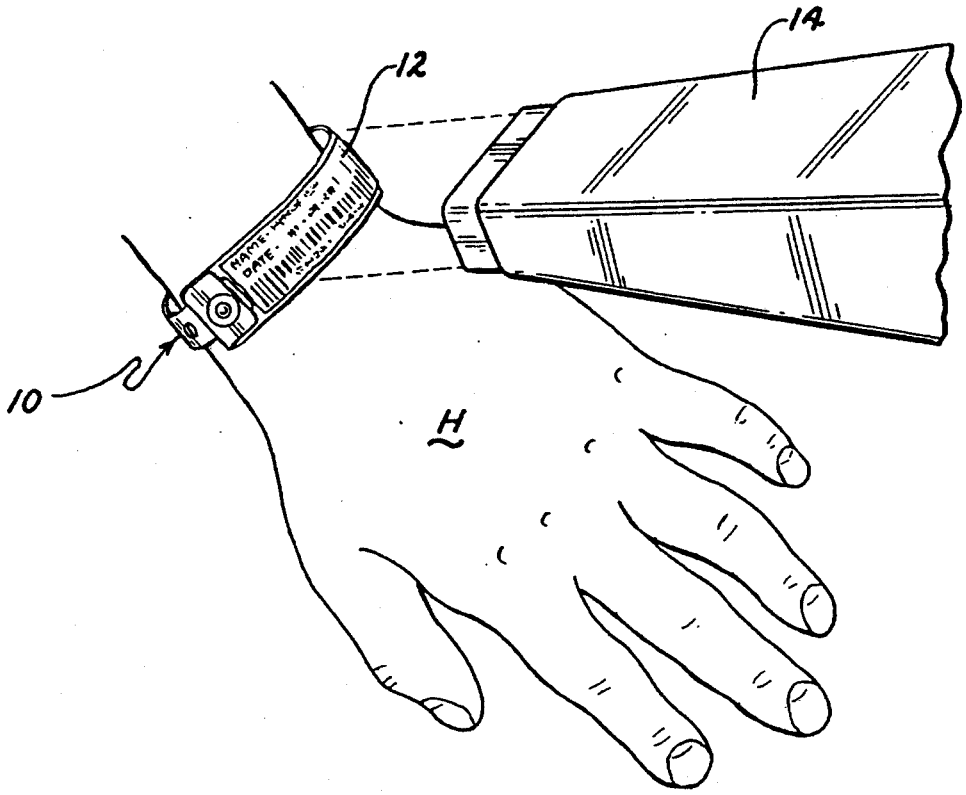
FIG. 1 is a perspective view showing a bracelet in position for scanning.

With reference to the drawings, and in particular to FIG. 1, the identification bracelet of the present invention is generally indicated by reference numeral 10. Bracelet 10 is worn on wrist W of the adults and children who visit a facility offering child care services in a segregated portion of the establishment. Such establishments may include large shopping malls or restaurants. Additionally, facilities such as amusement parks, where large numbers of young people and adults mingle in crowds, may provide the present child loss prevention system to their patrons who have children as a way to prevent lost children from being taken from the premises by adults other than those with whom they arrived.

Figure 2:
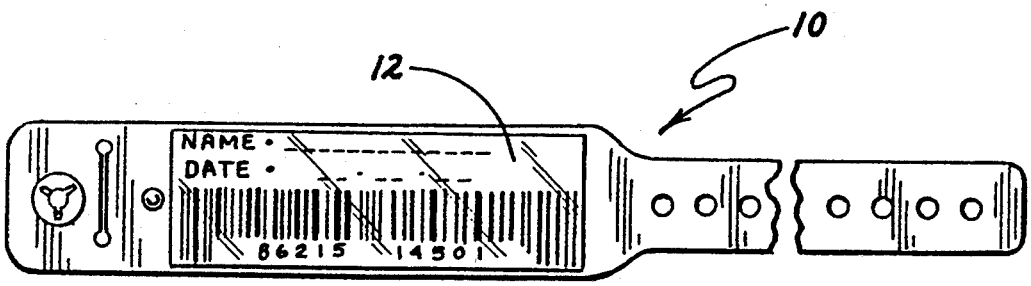
FIG. 2 is a plan view of a bracelet showing printed information.

Identification bracelet 10 is the type of bracelet commonly used in hospitals to identify patients. Bracelet 10 is easy to attach to the wrist of the person wearing it, but may only be removed by cutting it off with a scissors or in some other manner that results in visible signs of damage or tampering. Identification insert 12 is contained within bracelet 10 for easy display. As shown in FIG. 2, insert 12 may include bar code information or printed information in the form of names or dates or a random alphanumeric character sequence. Various algorithms are known for providing securely coded information. It is important that the code or legend printed on insert 12 be easily detectable and readable by an electronic scanning device, such as hand-held scanner 14.

Figure 3:
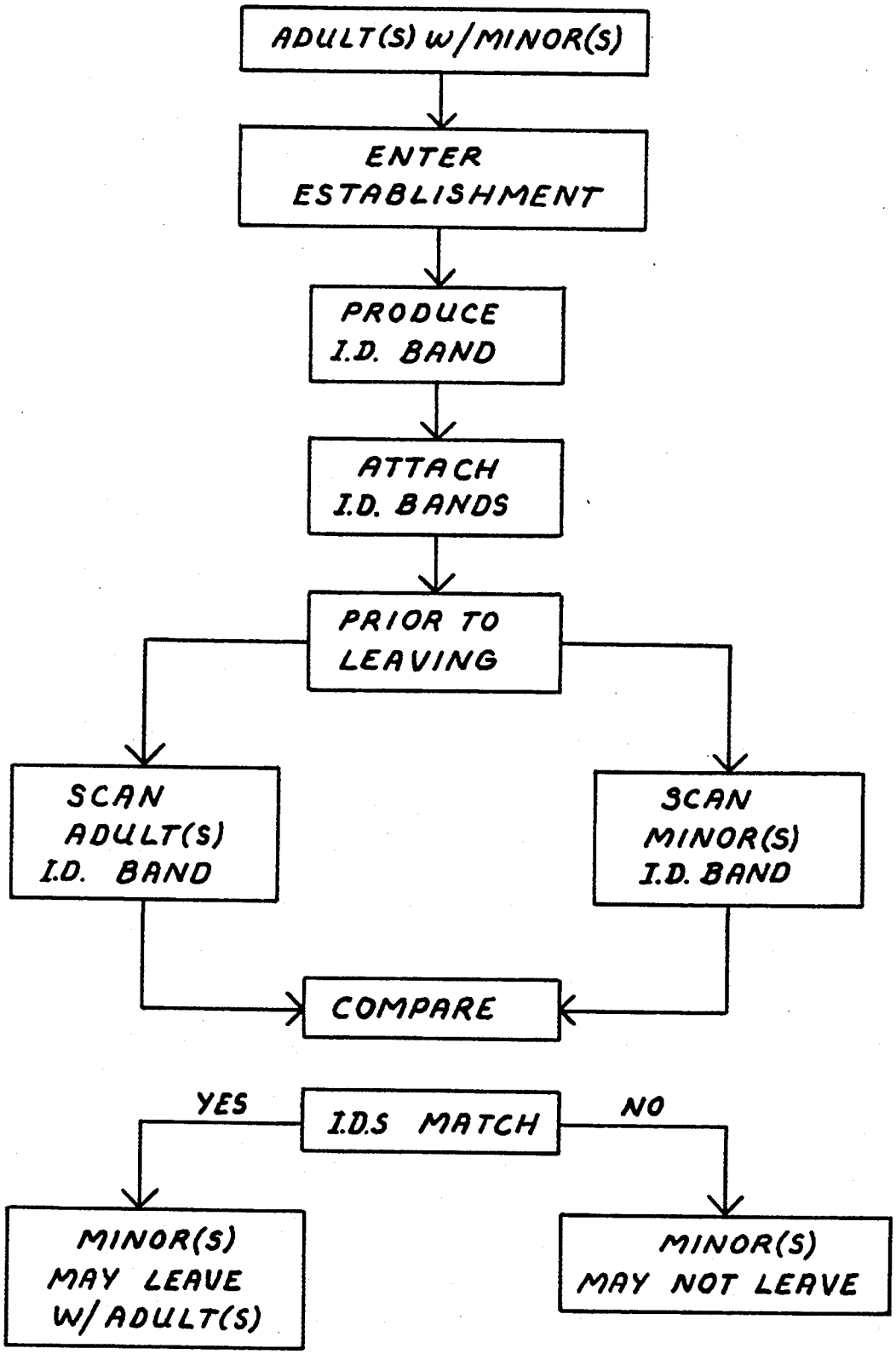
FIG. 3 is a flow chart showing the steps of the invention.

As indicated on the flow chart in FIG. 3, the first step of the process begins when one or more adults accompanying one or more children enters an establishment, such as an amusement park or shopping mall. The first setting in which the child loss prevention system is effective is where there are many people and children may be easily separated from their adult escort due to the size of the crowd, the adults may wish to keep the children with them, but acquire identification bracelets 10 to help find a lost child or prevent a child from being abducted by a stranger. In such an environment, it is preferable if the management of the establishment require that all adults and children on the premises wear identification bracelets 10 to guarantee the effectiveness of the system. Here the child and adult will need to have matching or complementary information on insert 12 to be allowed to leave the premises.

The second setting where the child loss prevention system is effective is at locales such as restaurants or night clubs where the adults, usually one or both parents, leave the child or children in the custody of a child care service provided in a segregated location within the establishment. Here the child and adult will need to have matching or complementary information on insert 12 of bracelet 10 for the child to be turned over to the custody of the adult.

Referring again to FIG. 3, the next step after entering the establishment is to generate identification bracelets 10 for each adult and child. It is preferred that a single unique code be generated and then assigned to each adult and child in the group. The code is preferably generated by a computer and printed on insert 12 by a printer attached to the computer. Printers are known and available that are capable of printing bar code or alphanumeric characters on media of various sizes, including those that may fit within commonly used identification bracelets 10. It may also be desirable to log additional identification information in a computer database for assistance in the event a lost child is brought to a security office looking for its parents, for example. Such data may include name, gender and date of birth for each child and adult receiving a bracelet 10.

The code generated for the people receiving bracelets 10 is printed on insert 12. The code may incorporate information such as name or date of birth in alphanumeric characters or a bar code, or the code may correspond to a string of characters generated at random. Identical codes may be assigned to all children and adults in a particular group. Alternatively, algorithms are known for generating unique codes that are understood by the appropriate code generation program to be related to each other, even though they differ slightly one from the next.

After the code is generated and printed on insert 12, it is placed in bracelet 10, which is then attached to the wrist of the child or adult identified thereby. The bracelets must be worn by the child and adult throughout their visit in the establishment. If the bracelet is removed or shows signs of tampering, the child will not be turned over to the custody of the adult without further investigation by the child care personnel.

At the time of leaving the establishment, the bracelets of all children and adults in the group are scanned. Scanner 14, preferably attached to a computer, acts as an input device that sends data to a program running on the computer. A number of algorithms may be employed by the program for analyzing the codes scanned by scanner 14. As discussed above, it is preferable that each of the codes for the members of a single group be identical to the rest. The computer, then, would read the initial code, then compare the subsequent codes to determine whether they were identical to the first. When insert 12 of the last bracelet 10 has been scanned, the computer is given a command by the operator to tell it that the next code will be a new one and is not being checked to see whether it is identical to the prior codes.

An alternative algorithm would analyze the codes retrieved by scanner 14 to see whether they are similar enough, although not identical, to be related in a fashion as described above for nonidentical codes. Again, after the last code of a group was scanned, the scanning program would be notified that a new series of codes was about to be entered, unrelated to the previous codes.

If the establishment being visited has multiple entry and exit points, such as an amusement park, it may be necessary for the data printed on identification insert 12 to be stored in a networked computer system to permit verification of a scanned code if the persons with bracelets 10 choose to leave by an exit point different from where they entered.

After inserts 12 of bracelets 10 have been scanned by scanner 14, the program determines whether the codes are identical or related. If not, the child will not be allowed to leave the premises with the adult, pending a further investigation. If the codes are similar or identical, the child will be allowed to leave with the adult.

While the preferred embodiments of the invention have been described, it should be understood that various changes, adaptations and modifications may be made therein without departing from the spirit of the invention and the scope of the appended claims.

What is claimed is:

1. Apparatus for preventing the abduction and loss of children from public facilities, the apparatus being usable by a group of people including at least one adult and all minor children accompanying that adult, to help ensure that the minor children leave the public facility with the same adult or adults with whom they entered, the apparatus comprising:

at least two identification bracelets, one said bracelet affixed to each adult and accompanying child in the group of people;

means for displaying a preprinted code on said at least two bracelets; and means for reading and comparing the preprinted code on each of said at least two bracelets.

2. The child loss prevention apparatus described in claim 1, wherein said means for displaying a preprinted code comprises:

a label, whereby said label may be affixed to said at least two bracelets.

3. The child loss prevention apparatus described in claim 1, wherein said code reading means comprises:

an electronic scanning device; and means for processing data obtained from said electronic scanning device.

4. The child loss prevention apparatus described in claim 3, wherein said means for processing data comprises:

a computer operatively connected to said electronic scanning device.

5. The child loss prevention apparatus described in claim 1, further comprising:

means for generating a unique code for display in said at least two identification bracelets; and means for printing said unique code.

6. The child loss prevention apparatus described in claim 5, wherein said code generation means comprises:

a computer.

7. The child loss prevention apparatus described in claim 6, wherein said code printing means comprises:

a printer operatively connected to said computer.

8. The child loss prevention apparatus described in claim 7, wherein said code reading means comprises:

an electronic scanning device; and means for processing data obtained from said electronic scanning device.

9. The child loss prevention apparatus described in claim 8, wherein said means for processing data comprises:

said computer, said electronic scanning device being operatively connected to said computer, said computer being capable of comparing said code generated by said computer with said data obtained from said electronic scanning device.

10. A method of preventing the abduction and loss of children from a public facility, the public facility having an entrance and an exit, the method including the use of wrist bands fastened to each child and at least one adult in each discrete group of children and adults, each wrist band including a unique code, the information in the code being capable of identifying each child and accompanying adult as part of a particular discrete group, the method also including the use of a computer for generating the codes, a printer connected to the computer for printing the code for display on the wrist bands, and an electronic scanner connected to the computer for comparing the codes on the wrist bands, the method comprising the steps of:

generating unique codes on the computer for the at least one child and at least one adult comprising a discrete group of children and adults;

printing the codes on a display medium using the printer connected to the computer, one code being printed on one said display medium for each child and adult in the discrete group of children and adults;

fixedly attaching each said display medium to a wrist band;

fixedly attaching one wrist band to each child and adult in the discrete group of children and adults;

scanning the codes on the wristbands of each child and at least one adult in the discrete group of children and adults with the electronic scanner attached to the computer; and comparing the scanned codes with the computer.

11. The method of preventing the abduction and loss of children described in claim 10, comprising the additional step of:

allowing the discrete group of children and adults to leave the public facility upon successfully matching the scanned codes with the computer, the matching of the scanned codes indicating that the children and adults in the discrete group of children and adults are the same as those that entered the public facility together.

12. The method of preventing the abduction and loss of children described in claim 10, comprising the additional step of:

detaining the discrete group of children and adults at the exit point of the public facility upon failure to successfully match the scanned codes with the computer, the failure to match the scanned codes indicating that the children and adults in the discrete group of children and adults are not the same as those that entered the public facility together.

13. The method of preventin athe abduction and loss of children described in claim 12, comprising the additional step of:

obtaining additional identifying information from the children and adults in the discrete group of children and adults to determine whether the children and adults in the discrete group of children and adults are the same as those that entered the public facility together.

14. A method of preventing the abduction and loss of children from a public facility, the public facility having an entrance and an exit, the public facility also having a facility for caring for children in the absense of the adults accompanying those children, the method including the use of wrist bands fastened to each child and at least one adult in each discrete group of children and adults, each wrist band including a unique code, the information in the code being capable of identifying each child and accompanying adult as part of a particular discrete group, the method also including the use of a computer for generating the codes, a printer connected to the computer for printing the code for display on the wrist bands, and an electronic scanner connected to the computer for comparing the codes on the wrist bands, the method comprising the steps of:

generating unique codes on the computer for the at least one child and at least one adult comprising a discrete group of children and adults;

printing the codes on a display medium using the printer connected to the computer, one code being printed on one said display medium for each child and adult in the discrete group of children and adults;

fixedly attaching each said display medium to a wrist band;

fixedly attaching one wrist band to each child and adult in the discrete group of children and adults;

allowing each child in the discrete group of children and adults to enter the facility for caring for children in the absense of the adults accompanying those children;

scanning the codes on the wristbands of each child and at least one adult in the discrete group of children and adults with the electronic scanner attached to the computer; and comparing the scanned codes with the computer.

15. The method of preventing the abduction and loss of children described in claim 14, comprising the additional step of:

allowing the children from the discrete group of children and adults to leave the facility for caring for children in the absence of the adults accompanying those children upon successfully matching the scanned codes with the computer, the matching of the scanned codes indicating that the children and adults in the discrete group of children and adults are the same as those that entered the public facility together.

16. The method of preventing the abduction and loss of children described in claim 14, comprising the additional step of:

detaining the discrete group of children and adults at the exit point of the public facility upon failure to successfully match the scanned codes with the computer, the failure to match the scanned codes indicating that the children and adults in the discrete group of children and adults are not the same as those that entered the public facility together.

17. The method of preventing the abduction and loss of children described in claim 16, comprising the additional step of:

obtaining additional identifying information from the children and adults in the discrete group of children and adults to determine whether the children and adults in the discrete group of children and adults are the same as those that entered the public facility together.

* * * * *